United States Patent [19]

Giles, III et al.

[11] 4,445,164

[45] Apr. 24, 1984

[54] LIGHTED KEY MODULE ASSEMBLY

[75] Inventors: John T. Giles, III, Kenosha, Wis.; Mark Hansen, Gurnee, Ill.

[73] Assignee: Cherry Electrical Products Corporation, Waukegan, Ill.

[21] Appl. No.: 374,968

[22] Filed: May 5, 1982

[51] Int. Cl.[3] ..... F21V 3/02

[52] U.S. Cl. ..... 362/311; 362/30; 362/85; 362/361; 362/363; 362/355; 362/375; 362/800; 200/314; 339/17 D

[58] Field of Search ..... 362/800, 85, 363, 30, 362/100, 28, 29, 23, 295, 335, 369, 375, 311, 444, 24, 361, 355; 339/17 D; 200/314; 340/815.13; 29/844, 853, 838,

[56] References Cited

U.S. PATENT DOCUMENTS

| | | | |
|---|---|---|---|
| 3,068,833 | 12/1962 | Hoffman | 362/23 X |
| 3,511,982 | 5/1970 | Salter | 339/17 D |
| 3,604,918 | 9/1971 | Cook et al. | 362/311 X |
| 3,805,004 | 4/1974 | Kondo et al. | 200/314 X |
| 3,849,621 | 11/1974 | Habecker | 200/314 X |
| 4,299,430 | 11/1981 | Baba et al. | 339/17 D |
| 4,370,533 | 1/1983 | Kamei et al. | 200/159 R |

*Primary Examiner*—Donald G. Kelly
*Assistant Examiner*—John S. Maples
*Attorney, Agent, or Firm*—Willian, Brinks, Olds, Hofer, Gilson & Lione Ltd.

[57] ABSTRACT

An improved lighted key assembly includes ridges located adjacent to the base and a ledge above the base. An LED, supported by the ledge, has leads which are mounted against the ridges so that an intermediate portion of the leads is bent around the bottom of the ridges. When mounted to the printed circuit board of a keyboard, the intermediate portions of the leads are in physical contact with contact pads on the printed circuit board to pass electrical current from the contact pads, through the leads, to the LED.

8 Claims, 5 Drawing Figures

LIGHTED KEY MODULE ASSEMBLY

BACKGROUND OF THE INVENTION

This invention relates to key module assemblies of the type frequently used in electrical keyboards. Such keyboards typically contain an underlying printed circuit board having an electrical circuit, and an array of pressure actuatable switches commonly referred to as keys. The keys may be mounted on a chassis plate which is secured to the printed circuit board. Depressing a selected key typically causes a change in the electrical response of the electrical circuit which, in turn, may cause the indicia on the selected key to be recorded, or the function identified by such indicia to be performed.

In many situations it is highly desirable for certain keys in keyboards of the type described to be capable of being illuminated. In the past this has been accomplished by providing a translucent window in a portion of the illuminatable key, and a lamp, such as a light emitting diode (LED), immediately under the translucent window. The leads from the LED are then passed through the chassis plate to the printed circuit board, where they are soldered to appropriate electrical terminals.

Though lighted key module assemblies of the type described have been successful, they are not without significant drawbacks. For example, it is highly desirable to be able to expeditiously remove the chassis plate from the printed circuit board even after the keyboard has been assembled. Such removal is, of course, significantly hampered if the LED leads are soldered to the printed circuit board. Though some attempts to provide a solderless connection have succeeded, this success has typically been at the expense of increasing the cost or the difficulty of assembly.

Accordingly, it is a primary object of this invention to provide an improved lighted key module assembly, and an improved method for mounting a lamp in such an assembly. It is a further object of the invention to provide an improved lighted key module assembly which can be assembled in a keyboard easily and inexpensively. Still another object of the invention is a keyboard assembly of the type described wherein the chassis plate can be expeditiously removed from the printed circuit board even after the keyboard has been assembled.

SUMMARY OF THE INVENTION

The foregoing objects of the invention, along with numerous features and advantages, are achieved in a lighted key assembly having a base, wall means extending upwardly from the base, and ledge means adjacent the wall means for supporting lamp means adapted to receive electrical current from underlying circuit means. The key assembly includes ridge means disposed along a portion of the wall means, having a lower surface adjacent the base, and electrical lead means. The electrical lead means have an intermediate portion substantially following the contour of the lower surface of the ridge means which is adapted to be aligned with, and in solderless contact against, a portion of the circuit means, whereby electrical current from the circuit means can be passed via the lead means to the lamp for facilitating the illumination thereof.

In another aspect of the invention there is provided a method for mounting a lamp adapted to receive electrical current from underlying circuit means, onto a lighted key assembly, comprising the steps of: mounting the lamp onto ledge means which are adjacent wall means extending upwardly from a base; moving a portion of the electrical lead, which extends from the lamp, against one side of ridge means disposed on the wall means; bending an intermediate portion of the lead around a lower surface of the ridge means, the lower surface being disposed adjacent the base; and moving another portion of the lead against the opposite side of the ridge means, whereby the intermediate portion of the lead is adapted to be aligned with, and in solderless contact against, a portion of the circuit means so that electrical current therefrom can be passed via the lead to the lamp for facilitating the illumination thereof.

BRIEF DESCRIPTION OF THE DRAWINGS

The aspects of the invention summarized above are illustrated in the accompanying drawings wherein.

DETAILED DESCRIPTION OF THE PREFERRED EMBODIMENT OF THE INVENTION

Figure 1:
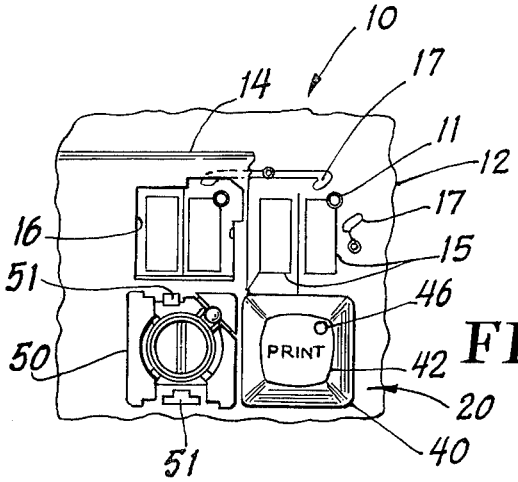
FIG. 1 is a schematic top view, partially cutaway, of a portion of a keyboard utilizing a preferred embodiment of the lighted key assembly of the invention.

Referring now to FIG. 1, there is shown a portion of an illustrative electrical keyboard 10 having an underlying printed circuit board 12. Printed circuit board 12 defines a screw hole 11, and carries circuit means which may include, among other circuit components, a pair of capacitor plates 15 and a pair of electrical contact pads 17. Capacitor plates 15 and contact pads 17 are coupled, via other portions of the circuit means to appropriate circuit components and elements (not shown) to provide an operative keyboard of the type well known in the art. Though keyboard 10 is a so-called capacitive keyboard, the present invention need not be so limited, the scope of the invention being defined by the appended claims.

Keyboard 10 further includes a chassis plate 14 which has an array of key openings, one of which is identified by reference numeral 16. A key switch 20 comprising, among other things, a key stem housing 50 and a key cap 40, is adapted to be mounted in each of key assembly openings 16 of chassis plate 14 by latches 51 in a manner well known in the art. Key cap 40 includes a translucent window 46 in a top surface 42 whose purpose will become apparent hereinafter.

Figure 2:
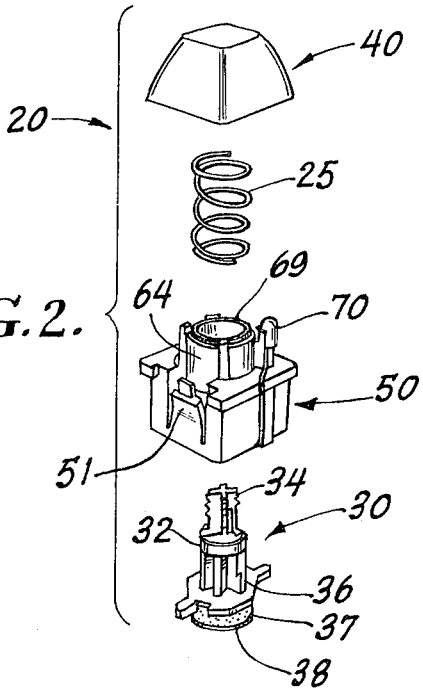
FIG. 2 is an exploded perspective view of the lighted key assembly shown in FIG. 1.

Key switch 20 is shown in greater detail in FIG. 2 where, in addition to key stem housing 50 and key cap 40, key switch 20 is also shown to include a key stem or plunger 30, and a coil spring 25. Key stem or plunger 30 is comprised of a stem member 32 having an upper portion 34 which frictionally engages a mating configuration (not shown) inside key cap 40, and a lower portion 36. Lower portion 36 terminates in a spongy disc section 37 whose lowermost surface is covered with a layer of conductive foil 38. In accordance with well known principles of capacitive keyboard operation, key stem or plunger 30 is lowered upon depression of its associated key cap 40, whereby foil 38 is brought into close, but non-contacting relationship with associated capacitor plates 15. This, in turn, changes the capacitance of the circuit means on printed circuit board 12 causing an appropriate indication that the selected key cap 40 has been depressed.

Stem member 32 of key stem assembly or plunger 30, particularly the upper portion 34, is adapted to extend upwardly through the substantially hollow key stem housing 50. The key stem housing 50 includes an upwardly extending member 64 having a top surface 69 adapted to support coil spring 25. When coil spring 25 has been so positioned, key cap 40 is secured to stem member 32 by frictionally engaging upper portion 34 with the mating configuration inside key cap 40 as described above. Coil spring 25 serves to return stem member 32, particularly the lower portion 36 containing the conductive foil 38, to its original position after pressure on the associated key cap 40 has been released. In accordance with typical keyboard operation, this enables the capacitance of the circuit means of printed circuit board 12 to return to its original circuit value.

Figure 3:
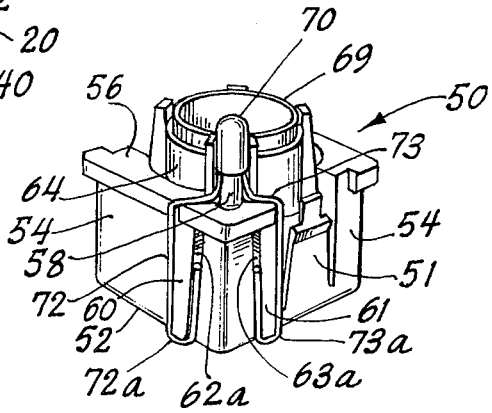
FIG. 3 is an enlarged, perspective view of a portion of the lighted key assembly shown in FIG. 2.
Figure 4:
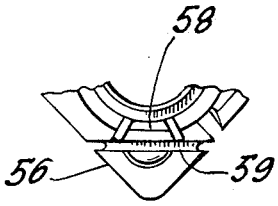
FIG. 4 is a top view of a portion of the lighted key assembly shown in FIG. 3.
Figure 5:
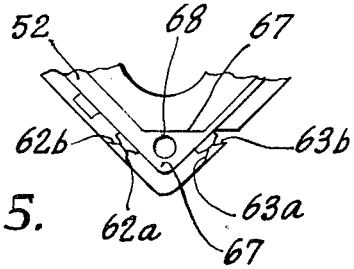
FIG. 5 is a bottom view of a portion of the lighted key assembly shown in FIG. 3.

Key stem housing 50 is shown in greater detail in FIGS. 3–5. In particular key stem housing 50 includes a base 52 which, in this embodiment, is of a substantially square configuration. A body portion in the form of walls 54 extends upwardly from base 52, meeting a top ledge 56 which preferably, but not necessarily, overhangs walls 54. Walls 54 define a pair of ridge sections 60,61. The sides of ridge section 60 define vertically extending grooves 62*a,b*. Similarly, the sides of ridge section 61 define a pair of vertically extending grooves 63*a,b*. Further, as shown best in FIG. 3, a portion of ridge sections 60,61—the lowermost portion in this particular embodiment—is disposed adjacent base 52 of key stem housing 50.

Ledge 56 supports a pedestal 58, located adjacent member 64, having a slot 59 extending substantially all the way down to ledge 56. Pedestal 58, in turn, supports a lamp preferably in the form of a light emitting diode (LED) 70. LED 70 includes a pair of electrical leads 72,73. Leads 72,73 are conventionally formed of bendable, electrically conductive material which proves to be particularly useful in the context of the present invention. More specifically, leads 72,73 are passed through separate portions of slot 59 and forced against ridge sections 60,61, respectively. The downwardly extending portion of lead 72 is positioned in groove 62*a*, an intermediate portion 72*a* of lead 72 is bent around the bottom of ridge section 60, and then the upwardly extending portion of lead 72 is positioned in groove 62*b*. Similarly, the downwardly extending portion of lead 73 is positioned in groove 63*a*, an intermediate portion 73*a* of lead 72 is bent around the bottom of ridge section 61, and then the upwardly extending portion of lead 73 is positioned in groove 63*b*. When leads 72,73 are mounted about ridge sections 60,61 in this manner, intermediate portions 72*a*, 73*a* extend slightly below base 52 of key stem housing 50.

Key stem housing 50 further includes latch members 51 which enable key switch 20 to be expeditiously mounted in opening 16 of chassis plate 14 shown in FIG. 1. When key switch 20 is so mounted, the intermediate portions 72*a,*73*a* of leads 72,73 which are bent around the bottom portions of ridge sections 60,61, respectively, are in electrical contact with electrical contact pads 17. This occurs because contact pads 17 are predisposed on printed circuit board 12 in accurate alignment under the bottom portions of ridge sections 60,61 so that intermediate portions 72*a,*73*a* of leads 72,73 necessarily contact electrical contact pads 17 upon proper mounting of key switch 20.

Though, as explained above, key stem housing 50 is hollow, it may be desirable to reinforce the base 52 with corner flanges such as flange 67 shown in FIG. 5. Moreover, in this preferred embodiment a screw hole 68 is defined in flange 67. When key switch 20 is mounted in opening 16 of chassis plate 14, screw hole 68 is aligned with a screw hole 11 in printed circuit board 11 as shown in FIG. 1. A screw (not shown) may then be screwed through screw hole 11 and screw hole 68 to removably fasten key switch 20 to printed circuit board 12. In addition, this ensures that the intermediate portions 72*a,*73*a* of leads 72,73 remain in fixed contact with corresponding contact pads 17. In view of the foregoing, it should be clear that the mounting of key switch 20 in opening 16 of chassis plate 14 automatically brings intermediate portions 72*a,*73*a* of leads 72,73 into solderless contact with contact pads 17. No special alignment apparatus is needed to achieve this result. Moreover, since the leads 72,73 are not soldered to the printed circuit board 12, the chassis plate 14 can be expeditiously attached thereto and removed therefrom.

In operation of keyboard 10, circuit means on printed circuit board 12 pass electric current via contact pads 17 and leads 72,73 to LED 70 to facilitate illumination thereof. The light from LED 70 is, of course, visible to a keyboard operator through translucent window 46 in the top surface 42 of key cap 40.

What has been described is an improved lighted key assembly particularly useful in electromechanical keyboards. Though the embodiment disclose herein is preferred, various modifications and changes which do not part from the true scope of the invention will be apparent to those skilled in the art. All such modifications and changes are intended to be covered by the appended claims.

We claim:

1. In a lighted key assembly having a housing with a base, wall means extending upwardly from said base, and ledge means, adjacent said wall means, the improvement comprising:

lamp means supported on said ledge means outside said housing for illuminating at least a portion of the key assembly;

ridge means disposed outside said housing along a portion of said wall means and having a lower end surface adjacent to said base;

electrical lead means extending from said lamp means along the contour of said ridge means, an intermediate portion of the lead means extending over said end surface of the ridge means and below said base; and circuit means abutting said base for supporting said housing, the circuit means including an electrically conducting and substantially flat contact pad means disposed beneath and pressing against said intermediate portion of the lead means in solderless conductive contact with the intermediate portion when the housing is supported on the circuit means in aligned relation with the contact pad means, the contact pad means and lead means cooperating to energize and illuminate said lamp means,

2. The key assembly of claim 1, wherein said contact pad means is a conducting contact dimensioned substantially the same as the lower end surface of said ridge means.

3. In a lighted key assembly having a housing with a base, wall means extending upwardly from said base, and ledge means, adjacent said wall means, the improvement comprising:

lamp means supported on said ledge means outside said housing for illuminating at least a portion of the key assembly;

ridge means disposed outside said housing along a portion of said wall means and having a lower end surface adjacent to said base;

circuit means supporting the base of the housing for applying electrical current to energize said lamp means;

means defining a groove in said wall means on at least one side of said ridge means; and electrical lead means extending from said lamp means along the contour of said ridge means and at least a portion of said groove, an intermediate portion of the lead means extending over said end surface of the ridge means and below said base;

said circuit means including an electrically conducting contact pad means disposed beneath and pressing against said intermediate portion of the lead means in solderless conductive contact with the intermediate portion when the housing is supported on the circuit means in aligned relation with the contact pad means, the contact pad means and lead means cooperating to energize and illuminate said lamp means.

4. In a lighted key assembly having a housing with a base, wall means extending upwardly from said base, and ledge means adjacent said wall means, the improvement comprising:

lamp means for illuminating at least a portion of the key assembly;

pedestal means disposed above said ledge means and outside said housing for supporting said lamp means, said pedestal means having a slot in the top surface thereof;

ridge means disposed outside said housing along a portion of said wall means and having a lower end surface adjacent to said base, the ridge means defining at least one groove with respect to said wall;

circuit means supporting the base of the housing for applying electrical current to energize said lamp means; and electrical lead means, extending from said lamp means through said slot and along the contour of said ridge means and at least a portion of said groove, an intermediate portion of the lead means extending over said end surface of the ridge means and below said base;

said circuit means including an electrically conducting contact pad means disposed beneath and pressing against said intermediate portion of the lead means in solderless conductive contact with the intermediate portion when the housing is supported on the circuit means in aligned relation with the contact pad means, the contact pad means and lead means cooperating to energize and illuminate said lamp means.

5. The key assembly defined in claims 1 or 3, wherein said ridge means includes two raised ridges, each ridge having side edges defining peripheral side grooves; and wherein said electrical lead means includes two electrical leads, each extending from said lamp along at least a portion of the grooves formed by the sides of an adjacent one of said ridges and around said lower end surface of said adjacent ridge.

6. A lighted switch key assembly, comprising:

a housing having side walls forming an open base at one end and supporting a top portion at the opposite end;

a plunger and means for slidably mounting the plunger for reciprocating movement through said top portion and into and out of the housing;

a key cap affixed to said plunger, the key cap having at least one translucent portion;

a printed circuit board abutting said base for supporting said housing, the printed circuit board including switching means for defining switching states in response to the movement of said plunger;

at least one lamp means for illuminating at least the translucent portion of the key cap in response to an energizing current;

means for supporting the lamp means on said top portion outside said housing and beneath said key cap;

at least two ridges formed on the walls of said housing, each ridge extending from a position adjacent to said lamp means to a position adjacent to the base and having an end face adjacent to the base;

at least two bendable electrically conducting leads connected to the lamp means for applying energizing current to illuminate the lamp means, each lead positioned adjacent to an associated one of said ridges;

each of said conducting leads bent to conform to the contour of its associated adjacent ridge, so that an intermediate portion of each lead lies along the end face of its associated ridge and below said base;

said printed circuit board including a plurality of conductive contacts, each contact disposed below an associated adjacent intermediate portion of a lead for conductively contacting the intermediate portion of the lead when the housing is supported on the printed circuit board, the contacts cooperating with their associated leads to provide energizing current to illuminate said lamp means.

7. The switch key assembly of claim 6, wherein said contacts are dimensioned substantially the same as the end faces of said ridges.

8. The switch key assembly of claim 6, wherein said lamp means is a light emitting diode.

* * * * *

UNITED STATES PATENT AND TRADEMARK OFFICE

CERTIFICATE OF CORRECTION

PATENT NO. : 4,445,164

DATED : April 24, 1984

INVENTOR(S) : John T. Giles III et al

It is certified that error appears in the above-identified patent and that said Letters Patent is hereby corrected as shown below:

Column 4, line 36, "disclose" should read -- disclosed --. Claim 1, line 3, after "and" insert -- a --. Claim 1, line 24, delete "," and insert therefor --. --. Claim 5, line 1, delete "or 3" and insert therefor -- or 3 or 4 --.

This certificate supersedes Certificate of Correction issued May 13, 1986.

Signed and Sealed this

*Fifth* Day of *August 1986*

[SEAL]

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,445,164

DATED : April 24, 1984

INVENTOR(S) : John T. Giles, III et al.

It is certified that error appears in the above-identified patent and that said Letters Patent is hereby corrected as shown below:

In the specification, column 4, line 36, delete "disclose" and insert therefor --disclosed--.

In the claims, claim 1, line 3, after "and" insert --a--.

Claim 1, line 24, delete "," and insert therefor --.--.

Claim 5, line 1, delete "or 3" and insert therefor --,3 or 4--.

This certificate supersedes Certificate of Correction issued August 5, 1986.

Signed and Sealed this

Sixth Day of January, 1987

*Attest:*

DONALD J. QUIGG

*Attesting Officer*

*Commissioner of Patents and Trademarks*